US009317056B2

(12) United States Patent
Lee

(10) Patent No.: US 9,317,056 B2
(45) Date of Patent: Apr. 19, 2016

(54) ACTIVE DRIVER AND SEMICONDUCTOR DEVICE HAVING THE SAME

(71) Applicant: SK hynix Inc., Gyeonggi-do (KR)

(72) Inventor: Hyun Chul Lee, Seoul (KR)

(73) Assignee: SK Hynix Inc., Gyeonggi-do (KR)

( * ) Notice: Subject to any disclaimer, the term of this patent is extended or adjusted under 35 U.S.C. 154(b) by 0 days.

(21) Appl. No.: 14/475,127

(22) Filed: Sep. 2, 2014

(65) Prior Publication Data

US 2015/0346757 A1 Dec. 3, 2015

(30) Foreign Application Priority Data

May 28, 2014 (KR) ..... 10-2014-0064723

(51) Int. Cl.
*G05F 3/16* (2006.01)

(52) U.S. Cl.
CPC ..... *G05F 3/16* (2013.01)

(58) Field of Classification Search
CPC ..... G11C 5/147; G11C 8/18; G11C 7/18; G11C 17/16; G11C 8/08; H01L 2224/73215; H01L 2224/83101; H01L 2224/32245; H01L 2924/00; G05F 1/465; G05F 3/205; G05F 3/245; H03K 5/1534; H03K 3/0231; H03K 3/03; H03K 3/354; H03K 5/12
USPC ..... 327/108, 109, 110, 111, 112
See application file for complete search history.

(56) References Cited

U.S. PATENT DOCUMENTS

2009/0168585 A1* 7/2009 Kang ..... G11C 5/143 365/226

FOREIGN PATENT DOCUMENTS

KR 100608112 8/2006

* cited by examiner

*Primary Examiner* — John Poos
(74) *Attorney, Agent, or Firm* — IP & T Group LLP

(57) ABSTRACT

An active driver includes a mirror circuit suitable for generating a drive voltage and a sink voltage using an external voltage, a first reset circuit suitable for outputting the drive voltage of a logic high level in a standby mode; a second reset circuit suitable for transitioning the drive voltage to a logic low level in response to the sink voltage when being changed from the standby mode to an active mode, and an output circuit suitable for outputting the external voltage as an internal voltage in response to the drive voltage when being changed from the standby mode to the active mode.

18 Claims, 4 Drawing Sheets

ACTIVE DRIVER AND SEMICONDUCTOR DEVICE HAVING THE SAME

CROSS-REFERENCE TO RELATED APPLICATION

The present application claims priority to Korean patent application number 10-2014-0064723, filed on May 28, 2014, the entire disclosure of which is incorporated herein in its entirety by reference.

BACKGROUND

1. Field of the Invention

Various exemplary embodiments of the present invention relate to an active driver and a semiconductor device having the same and, more particularly, to an active driver outputting an internal voltage of a semiconductor device.

2. Discussion of Related Art

Semiconductor devices include internal voltage generators for supplying stable power supply and ground voltages to its internal circuits.

The internal voltage generator operates in standby mode (a standby state) when the semiconductor device is not performing data input and output operations and active mode when the semiconductor device is performing data input and output operations. Therefore, internal voltage generators generally include both an active driver and a standby driver.

When changing from standby mode to active mode, due to structural and operational characteristics of the active driver, the output voltage level of the active driver may temporarily drop before rebounding to a normal level. This unwanted voltage drop in the power supply may result in operational concerns within the semiconductor device. It is therefore desirable to find a solution to this concern.

SUMMARY

Exemplary embodiments of the present invention are directed to an active driver with improved response speed and a semiconductor device having the same.

One embodiment of the present invention provides an active driver including a mirror circuit suitable for generating a drive voltage and a sink voltage using an external voltage, a first reset circuit suitable for outputting the drive voltage of a logic high level in a standby mode, a second reset circuit suitable for transitioning the drive voltage to a logic low level in response to the sink voltage when being changed from the standby mode to an active mode, and an output circuit suitable for outputting the external voltage as an internal voltage in response to the drive voltage when being changed from the standby mode to the active mode.

Another embodiment of the present invention provides a semiconductor device including an internal circuit in which data is stored, and an internal voltage generator suitable for supplying an internal voltage to the internal circuit when being changed from a standby mode to an active mode, wherein the internal voltage generator includes a mirror circuit suitable for generating a drive voltage and a sink voltage using an external voltage, a first reset circuit suitable for outputting the drive voltage of a logic high level in the standby mode, a second reset circuit suitable for transitioning the drive voltage to a logic low level state in response to the sink voltage when being changed from the standby mode to the active mode, and an output circuit suitable for outputting the external voltage as the internal voltage in response to the drive voltage when being changed from the standby mode to the active mode.

DETAILED DESCRIPTION

The present invention will be described more fully with reference to the accompanying drawings in which exemplary embodiments of the invention are shown. This invention may, however, be embodied in different forms and should not be construed as limited to the embodiments set forth herein. Exemplary embodiments of the present invention will described below in sufficient detail to enable those of ordinary skill in the art to practice the present invention.

Figure 1:
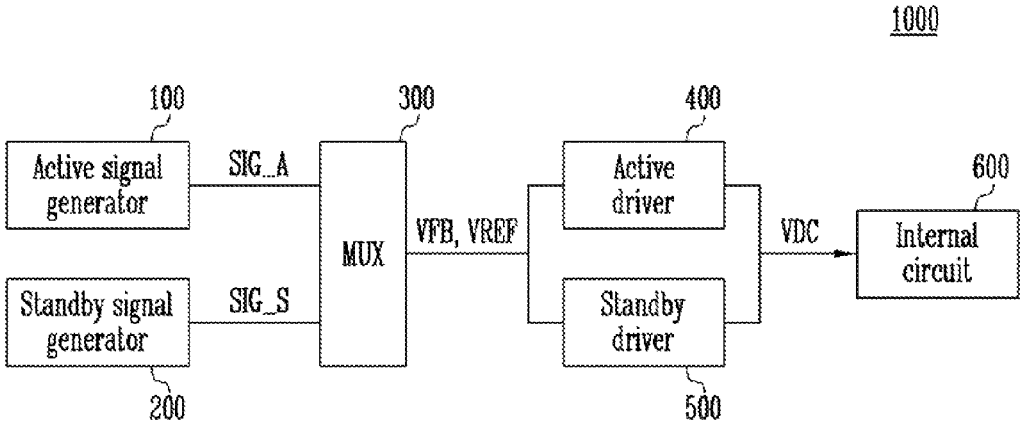
FIG. 1 is a block diagram for describing a semiconductor device according to an exemplary embodiment of the present invention.

FIG. 1 is a block diagram for describing a semiconductor device according to an exemplary embodiment of the present invention.

Referring to FIG. 1, a semiconductor device 1000 may include an internal circuit 600 in which data is stored and internal voltage generators 100, 200, 300, 400 and 500 configured to supply an internal voltage to the internal circuit 600.

The internal circuit 600 may include a memory cell array in which data is stored, and a circuit configured to program, read, or erase data of the memory cell array.

The internal voltage generators 100, 200, 300, 400 and 500 may include an active signal generator 100, a standby signal generator 200, a multiplexer (MUX) 300, an active driver 400, and a standby driver 500.

The active signal generator 100 may output an active signal SIG_A when the semiconductor device 1000 is in an active mode, and the standby signal generator 200 may output a standby signal SIG_S when the semiconductor device 1000 is in a standby mode.

The MUX 300 may output an active reference voltage VREF or a standby reference voltage VFB in response to the active signal SIG_A and the standby signal SIG_S, respectively. Further, the MUX 300 may output various signals for driving the active driver 400 and the standby driver 500.

The active driver 400 and the standby driver 500 may output an internal voltage VDC needed for the active mode and the standby mode in response to the various signals outputted from the MUX 300.

Among the components of the internal voltage generators described above, the active driver 400 will be described in detail below.

Figure 2:
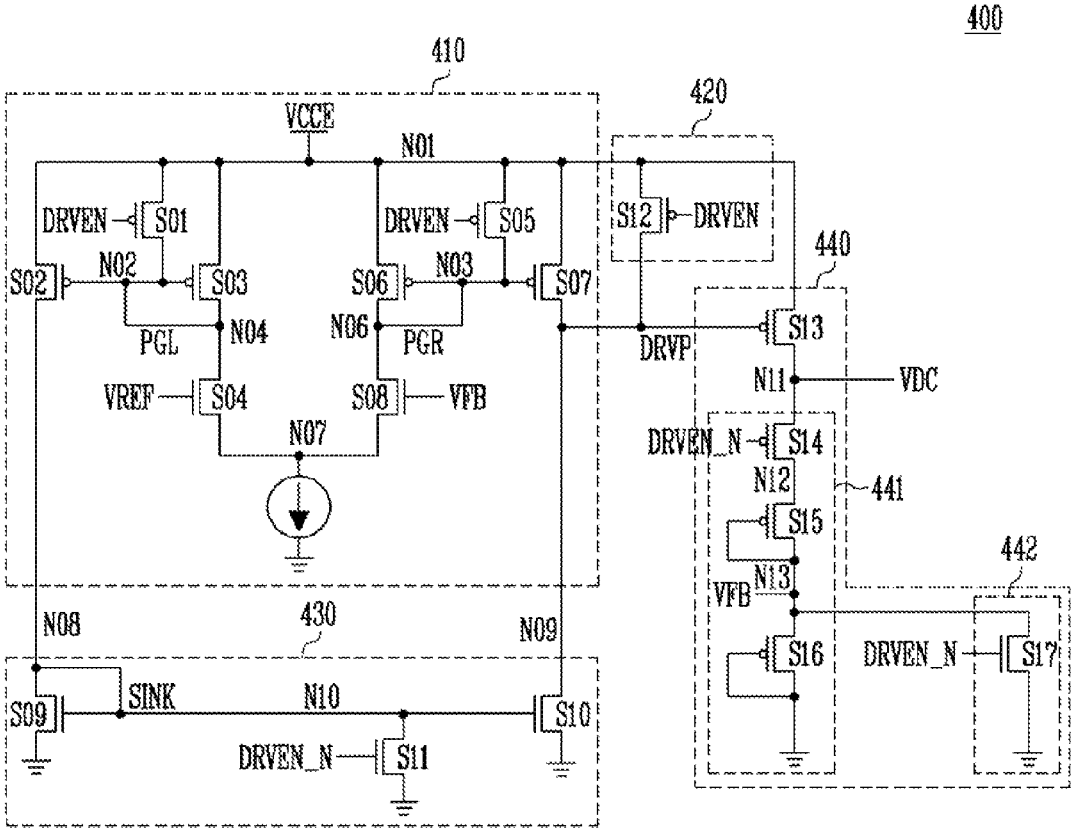
FIG. 2 is a circuit diagram for describing an active driver of FIG. 1 in detail.

FIG. 2 is a circuit diagram for describing the active driver of FIG. 1 in detail.

Referring to FIG. 2, the active driver 400 may include a mirror circuit 410, a first reset circuit 420, a second reset circuit 430, and an output circuit 440.

The mirror circuit 410 may receive an external voltage VCCE, and output the received external voltage VCCE as a constant drive voltage DRVP based on the active reference voltage VREF and the standby reference voltage VFB. The mirror circuit 410 will be described in detail below.

The mirror circuit 410 may include first to eighth switches S01 to S08 connected between a first node N01, to which the external voltage VCCE is applied, and a seventh node N07, connected to a ground terminal, and may be configured to perform a mirroring operation. The first switch S01 may connect or disconnect the first node N01 and a second node N02 in response to a drive enable signal DRVEN, and may include a P-channel metal oxide semiconductor (PMOS) transistor. The second switch S02 may connect or disconnect the first node N01 and an eighth node N08 in response to a first active voltage PGL applied to the second node N02, and may include a PMOS transistor. The third switch S03 may connect or disconnect the first node N01 and a fourth node N04 in response to the first active voltage PGL applied to the second node N02, and may include a PMOS transistor. The second node N02 and the fourth node N04 may be connected to each other. Accordingly, the first active voltage PGL may be applied to the second and fourth nodes N02 and N04 in common. The fourth switch S04 may connect or disconnect the fourth node N04 and a seventh node N07 in response to the active reference voltage VREF, and may include an N-channel metal oxide semiconductor (NMOS) transistor.

The fifth switch S05 may connect or disconnect the first node N01 and a third node N03 in response to the drive enable signal DRVEN, and may include a PMOS transistor. The sixth switch S06 may connect or disconnect the first node N01 and a sixth node N06 in response to a second active voltage PGR applied to the third node N03, and may include a PMOS transistor. The seventh switch S07 may connect or disconnect the first node N01 and a ninth node N09 in response to the second active voltage PGR applied to the third node N03, and may include a PMOS transistor. The third node N03 and the sixth node N06 may be connected to each other. Accordingly, the second active voltage PGR may be applied to the third and sixth nodes N03 and N06 in common. The eighth switch S08 may connect or disconnect the third node N03 and the seventh node N07 in response to the standby reference voltage VFB, and may include an NMOS transistor.

The drive enable signal DRVEN may be maintained at a "low" level in the standby mode, and may transition to a "high" level when being changed into the active mode. Further, in the standby mode, the active reference voltage VREF and the standby reference voltage VFB may be maintained at the "low" level, but the active reference voltage VREF may have a slightly higher level than the standby reference voltage VFB. When being changed from the standby mode to the active mode, the active reference voltage VREF and the standby reference voltage VFB may simultaneously transition to the "high" level. However, the active reference voltage VREF may reach the "high" level prior to the standby reference voltage VFB since the active reference voltage VREF has a higher level than the standby reference voltage VFB in the "low" level.

The first reset circuit 420 may include a twelfth switch S12 configured to connect or disconnect the first node N01 and the ninth node N09 in response to the drive enable signal DRVEN, and may include a PMOS transistor. In the standby mode, the first reset circuit 420 may reset the drive voltage DRVP that is a voltage of the ninth node N09 as a "high" level.

The second reset circuit 430 may include ninth to eleventh switches S09 to S11 configured to discharge a potential of the ninth node N09 in response to a voltage of the eighth node N08. The ninth switch S09 may connect or disconnect the eighth node N08 and a ground terminal in response to the sink voltage SINK applied to a tenth node N10, and may include an NMOS transistor. The tenth node N10 may be connected to the eighth node N08. Since the sink voltage SINK is applied to the tenth node N10 and the eighth node N08, the ninth switch S09 may be a diode having a forward bias in a direction from the eighth node N08 toward a ground terminal. The eleventh switch S11 may connect or disconnect the tenth node N10 and the ground terminal in response to an inverted drive enable signal DRVEN_N, and may include an NMOS transistor. The inverted drive enable signal DRVEN_N may have an inverted level of the drive enable signal DRVEN.

The output circuit 440 may include a thirteenth switch S13 operating in response to the drive voltage DRVP, and a current path circuit 441 and a discharge circuit 442. The output circuit 440 is configured to output the Internal voltage VDC in response to the inverted drive enable signal DRVEN_N and the drive voltage DRVP.

The thirteenth switch S13 may connect or disconnect the first node N01 and an eleventh node N11 in response to the drive voltage DRVP, and may include a PMOS transistor. The eleventh node N11 may be an output node of the active driver 400.

The current path circuit 441 may include fourteenth to sixteenth switches S14 to S16 connected between the eleventh node N11 and a ground terminal in series. The fourteenth switch S14 may connect or disconnect the eleventh node N11 and a twelfth node N12 in response to the inverted drive enable signal DRVEN_N, and may include a PMOS transistor. The fifteenth switch N15 may be a diode having a forward bias in a direction from a thirteenth node N13 toward the twelfth node N12, and the sixteenth switch S16 may be a diode having a forward bias in a direction from the ground terminal toward the thirteenth node N13. Each of the fifteenth and sixteenth switches S15 and S16 may include a PMOS transistor. Particularly, the standby reference voltage VFB may be applied to the thirteenth node N13.

The discharge circuit 442 may include a seventeenth switch S17 configured to discharge a potential of the thirteenth node N13 in response to the inverted drive enable signal DRVEN_N in the standby mode. The seventeenth switch S17 may connect or disconnect the thirteenth node N13 and a ground terminal in response to the inverted drive enable signal DRVEN_N, and may include an NMOS transistor.

An operation of the active driver 400 will be described below in detail with reference to the circuit diagram described above.

Figure 3:
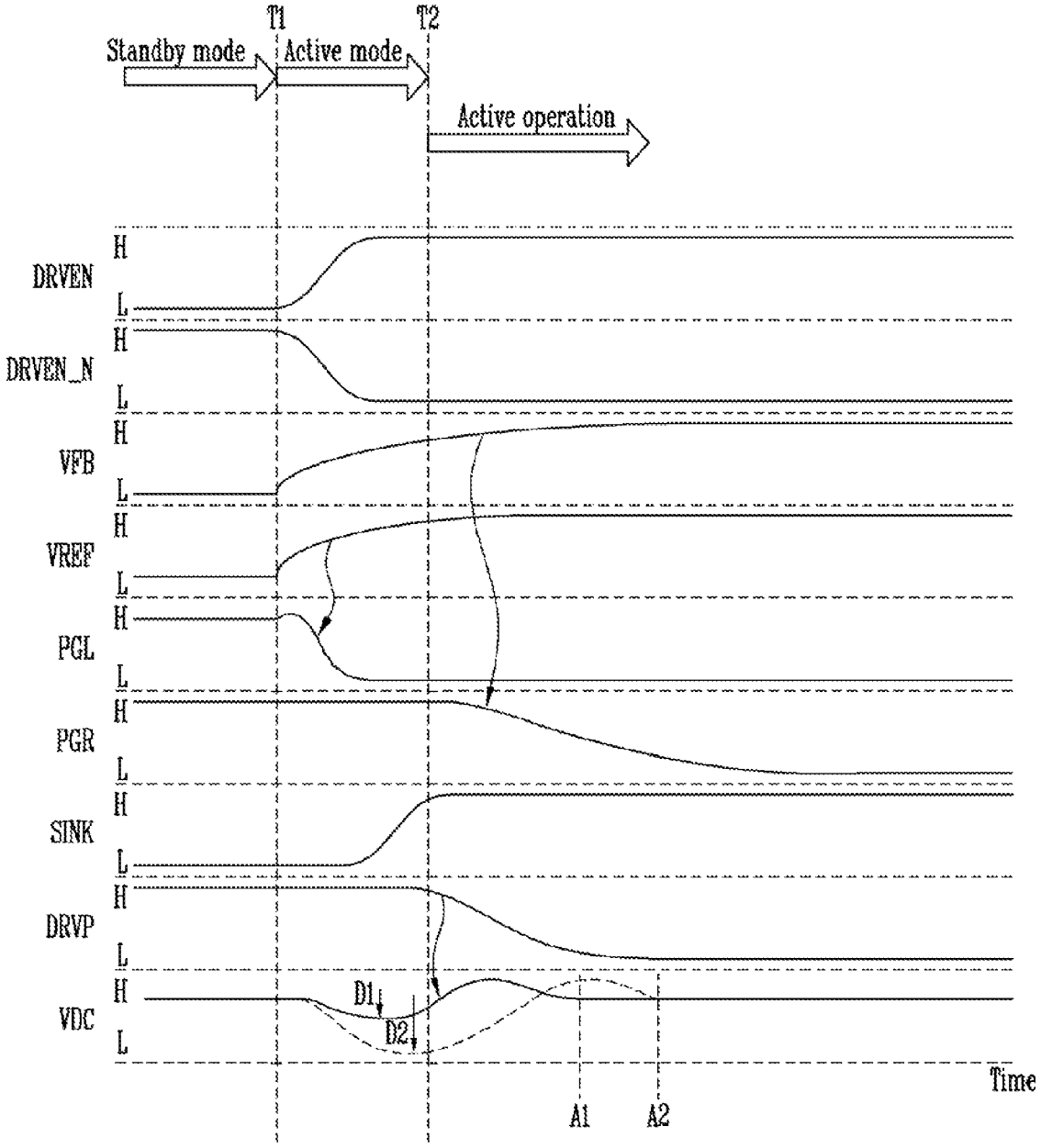
FIG. 3 is a timing diagram for describing a method of operating an active driver according to an exemplary embodiment of the present invention.

FIG. 3 is a timing diagram for describing a method of operating an active driver according to an exemplary embodiment of the present invention.

Referring to FIG. 3, the active driver may generate a floating state of an output node in the standby mode, and output the internal voltage VDC through the output node when being changed from the standby mode to the active mode. A detailed description is as follows.

Standby Mode

In the standby mode, the drive enable signal DRVEN may be in a "low" level (L), and the inverted drive enable signal DRVEN_N may be in a "high" level (H). The active reference voltage VREF may have a "low" level (L).

Since the fifth switch (S05 of FIG. 2) may be turned on in response to the drive enable signal DRVEN at the "low" level (L), the potential of the third node (N03 of FIG. 2) may have the "high" level (H). Accordingly, the second active voltage PGR may have the "high" level (H). When the second active voltage PGR may have the "high" level (H), the sixth and seventh switches (S06 and S07 of FIG. 2) may be turned off. Since the inverted drive enable signal DRVEN_N is in the "high" level (H), the seventeenth switch (S17 of FIG. 2) of the output circuit 440 may be turned on, and the thirteenth node (N13 of FIG. 2), to which the standby reference voltage VFB is applied, may have a potential of the "low" level (L). Since the standby reference voltage VFB has the "low" level (L), the eighth switch (S08 of FIG. 2) may be turned off.

Since the first switch (S01 of FIG. 2) is turned on in response to the drive enable signal DRVEN of the "low" level (L), the potential of the second node (N02 of FIG. 2) may have the "high" level (H). Accordingly, the first active voltage PGL may have the "high" level (H). When the first active voltage PGL has the "high" level (H), the second and third switches (S02 and S03 of FIG. 2) may be turned off. Since the active reference voltage VREF has the "low" level (L), the fourth switch (S04 of FIG. 2) may be turned off.

The eleventh switch (S11 of FIG. 2) may be turned on in response to the inverted drive enable signal DRVEN_N at the "high" level (H), and the tenth node (N10 of FIG. 2) may be grounded. Since the tenth node N10 is grounded, the sink voltage SINK may have the "low" level (L). Since the sink voltage SINK has the "low" level (L), the ninth and tenth switches (S09 and S10 of FIG. 2) may be turned off.

Even when the seventh and tenth switches (S07 and S10 of FIG. 2) are turned off, the twelfth switch (S12 of FIG. 2) may be turned on in response to the drive enable signal DRVEN at the "low" level (L). Accordingly, since the first node N01 and the ninth node N09 are connected to each other, the drive voltage DRVP at the "high" level (H) may be applied to the ninth node N09. Since the drive voltage DRVP has the "high" level (H), the thirteenth switch (S13 of FIG. 2) of the output circuit (440 of FIG. 2) may be turned off. Accordingly, the external voltage VCCE applied to the first node N01 may not be transferred to the eleventh node N11 that is the output node of the active driver 400.

Since the inverted drive enable signal DRVEN_N is in the "high" level (H), the fourteenth switch (S14 of FIG. 2) of the output circuit may be turned off. Since the thirteenth and fourteenth switches (S13 and S14) are turned off, the eleventh node N11 that is the output node of the active driver 400 may be in a floating state.

Particularly, since the seventeenth switch (S17 of FIG. 2) is turned on in response to the inverted drive enable signal DRVEN_N of the "high" level (H), the thirteenth node N13 may be grounded. Accordingly, since the fifteenth switch (S15 of FIG. 2) is turned on, the twelfth node (N12 of FIG. 2) may be grounded.

When being changed from the standby mode described above to the active mode, the potential of each of the switches and nodes will be described below.

Active Mode

When being changed to the active mode at time T1, the drive enable signal DRVEN may transition to the "high" level (H), and the inverted drive enable signal DRVEN_N may transition to the "low" level (L). The active reference signal VREF may transition to the "high" level (H).

Since the drive enable signal DRVEN is in the "high" level (H), the first and fifth switches S01 and S05 may be turned off. Since the active reference voltage VREF has the "high" level (H), the fourth switch S04 may be turned on, and the first active voltage PGL may be lowered to the "low" level (L). Since the first active voltage PGL has the "low" level (L), the second and third switches S02 and S03 may be turned on. Since the fourth switch S04 is turned on, the fourth node N04 may be maintained at a ground state even when the third switch S03 is turned on.

Since the external voltage VCCE is applied to the eighth node N08 when the second switch S02 is turned on, the sink voltage SINK may be increased to the "high" level (H). At this time, since the inverted drive enable signal DRVEN_N is in the "low" level (L), the eleventh switch S11 may be turned off. Since the tenth switch S10 is turned on when the sink voltage SINK has the "high" level (H), the ninth node N09 may be grounded. Since the drive voltage DRVP has the "low" level (L) when the ninth node N09 is grounded, the thirteenth switch S13 may be turned on.

When the thirteenth switch S13 is turned on, the external voltage VCCE may be transferred to the eleventh node N11. At this time, since the inverted drive enable signal DRVEN_N is in the "low" level (L), the seventeenth switch S17 may be turned off, and the fourteenth to the sixteenth switches S14 to S16 may be turned on. A current path may be formed between the eleventh node N11 and the ground terminal. That is, when the thirteenth switch S13 is turned on, the external voltage VCCE may be transferred to the output node, and the fourteenth to sixteenth switches S14 to S16 may be turned on to form a current path between the output node and the ground terminal. However, a constant internal voltage VDC may be outputted through the output node due to resistance between the fourteenth to sixteenth switches S14 to S16.

Particularly, since potentials of the thirteenth and twelfth nodes N13 and N12 of the output circuit 440 are in the "low" level (L) in the standby mode, the active reference voltage VREF may have a higher level than the standby reference voltage VFB when being changed to the active mode. Accordingly, the first active voltage PGL may be quickly lowered to the "low" level (L), and thus the second switch S02 may be quickly turned on. The faster the turn-on time of the second switch S10 is, the sooner the sink voltage SINK is increased to the "high" level (H). When the tenth switch S10 is quickly turned on, the drive voltage DRVP may quickly transition to the "low" level (L). The sooner the drive voltage DRVP transitions to the "low" level (L), the sooner the internal voltage VDC is outputted.

Accordingly, if the standby reference voltage VFB is in the high level when the standby mode is changed to the active mode, the internal voltage VDC may drop to a level D2, and the internal voltage VDC may reach a normal level at a time A2. However, when the reference voltage VFB is in the low level, the internal voltage VDC may drop to a level D1 higher than the level D2, and the internal voltage VDC may become a normal level at a time A1 shorter than the time A2.

Accordingly, the change from the standby mode to the active mode may be performed quickly, and an excessive internal voltage drop may be prevented.

Figure 4:
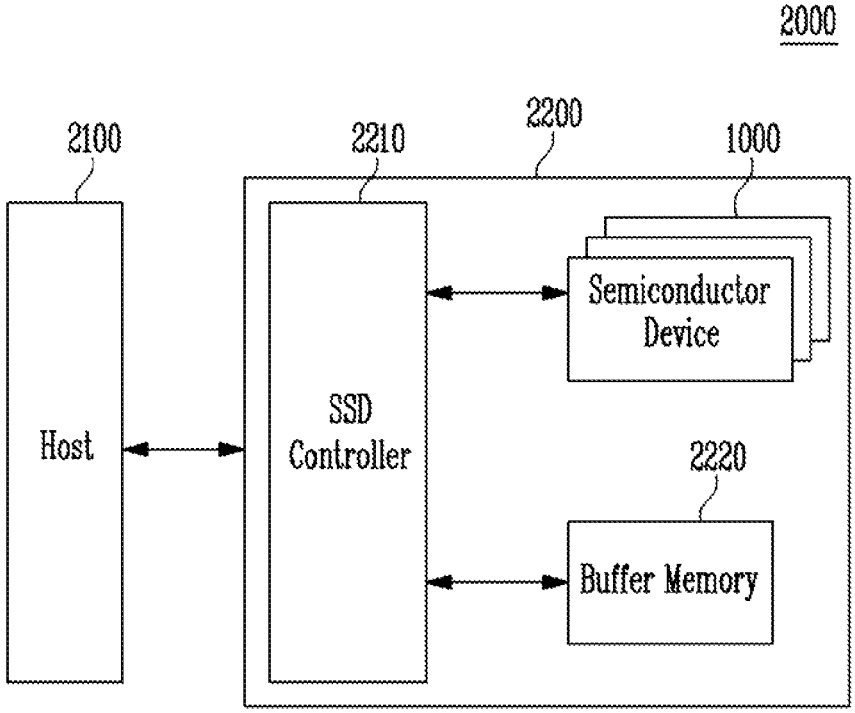
FIG. 4 is a block diagram for describing a solid state drive including a semiconductor device according to an exemplary embodiment of the present invention.

FIG. 4 is a block diagram for describing a solid state drive including a semiconductor device according to an exemplary embodiment of the present invention.

Referring to FIG. 4, a drive device 2000 may include a host 2100, and a solid state drive (SSD) 2200. The SSD 2200 may include a SSD controller 2210, a buffer memory 2220, and a semiconductor device 1000.

The SSD controller 2210 may provide a physical connection between the host 2100 and the SSD 2200. That is, the SSD controller may provide an interface with the SSD 2200 to the host 2100 in response to a bus format of the host 2100. Particularly, the SSD controller 2210 may decode a command provided from the host 2100. The SSD controller 2210 may access the semiconductor device 1000 based on the decoded result. The bus format of the host 2100 may include at least one among a universal serial bus (USB) protocol, a small computer system interface (SCSI) protocol, a peripheral component interconnect-express (PCI-Express) protocol, an advanced technology attachment (ATA) protocol, a parallel-ATA (PATA) protocol, a serial-ATA (SATA) protocol, a serial attached SCSI (SAS) protocol, etc.

The buffer memory 2220 may temporarily store program data provided from the host 2100 or data read from the internal circuit 600 of the semiconductor device 1000. When there is data read from the semiconductor device 1000 in the buffer memory 2220 on a read request of the host 2100, the buffer memory 2220 may provide a cache function in which the temporarily stored data is directly provided to the host 2100. Generally, the data transmission speed of the bus format (for example, SATA or SAS protocol) of the host 2100 is faster than that of a memory channel of the SSD 2200. That is, when an interface speed of the host is faster than the data transmission speed of the memory channel of the SSD 2200, performance degradation generated due to the speed difference may be minimized by providing the buffer memory 2220 with a large capacity. The buffer memory 2220 may include a synchronous dynamic random access memory (DRAM) in order to provide sufficient buffering in the SSD 2200, which is used as a large-capacity auxiliary memory device.

The semiconductor device 1000 may be provided as a storage medium of the SSD 2200. For example, the semiconductor device 1000 may be a non-volatile memory device with a large storage capacity as described above in FIG. 1, and the non-volatile memory device may be a NAND-type flash memory.

Figure 5:
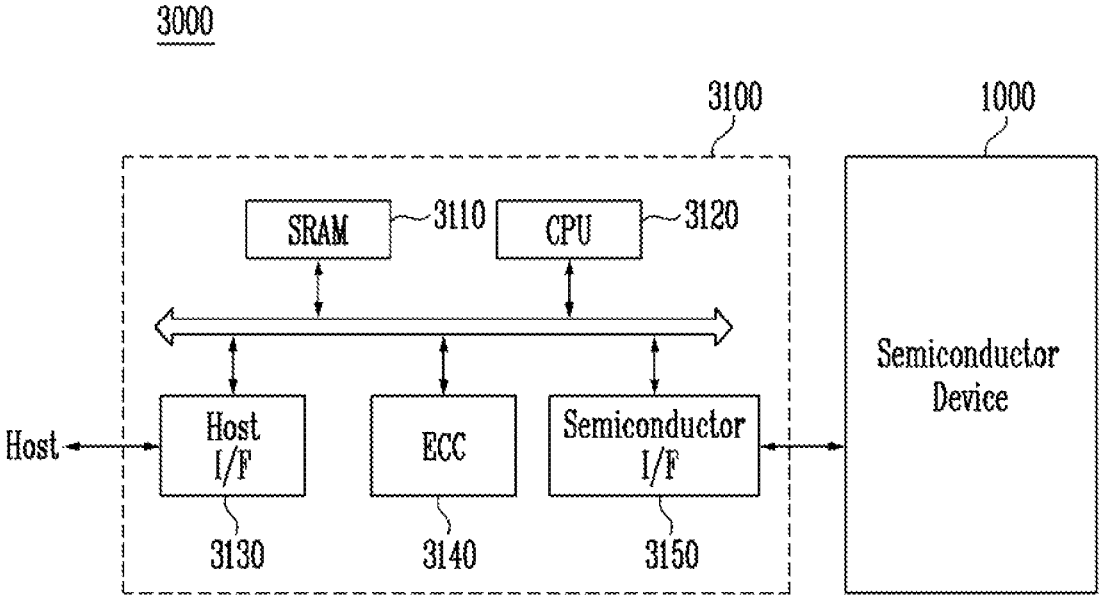
FIG. 5 is a block diagram for describing a memory system including a semiconductor device according to an exemplary embodiment of the present invention.

FIG. 5 is a block diagram for describing a memory system including a semiconductor device according to an exemplary embodiment of the present invention.

Referring to FIG. 5, a memory system 3000 according to the embodiment of the present invention may include a memory controller and a semiconductor device 1000.

Since the semiconductor device 1000 may be configured with substantially the same construction as FIG. 1, a detailed description of the semiconductor device 1000 will be omitted.

The memory controller 3100 may be configured to control the semiconductor device 1000. A static random access memory (SRAM) may be used as an operating memory of a central processing unit (CPU) 3120. A host interface (I/F) 3130 may include a data exchange protocol of a host connected to the memory system 3000. An error correction circuit (ECC) 3140 may detect and correct an error included in data read from the internal circuit 600 of the semiconductor device 1000. A semiconductor interface (I/F) 3150 may interface with the semiconductor device 1000. The CPU 3120 may perform a control operation for data exchange of the memory controller 3100. Further, although not shown in FIG. 5, the memory system 3000 may further include a read only memory (ROM), etc., for storing code data for an interface with the host.

The memory system 3000 according to the embodiment of the present invention may be applied to various device including, but not limited to, a computer, an ultra mobile personal computer (UMPC), a workstation, a net-book, a personal digital assistant (PDA), a portable computer, a web tablet, a wireless phone, a mobile phone, a smart phone, a digital camera, a digital audio recorder, a digital audio player, a digital picture recorder, a digital picture player, a digital video recorder, a digital video player, a device for wirelessly transmitting and receiving information, and various devices configuring a home network.

Figure 6:
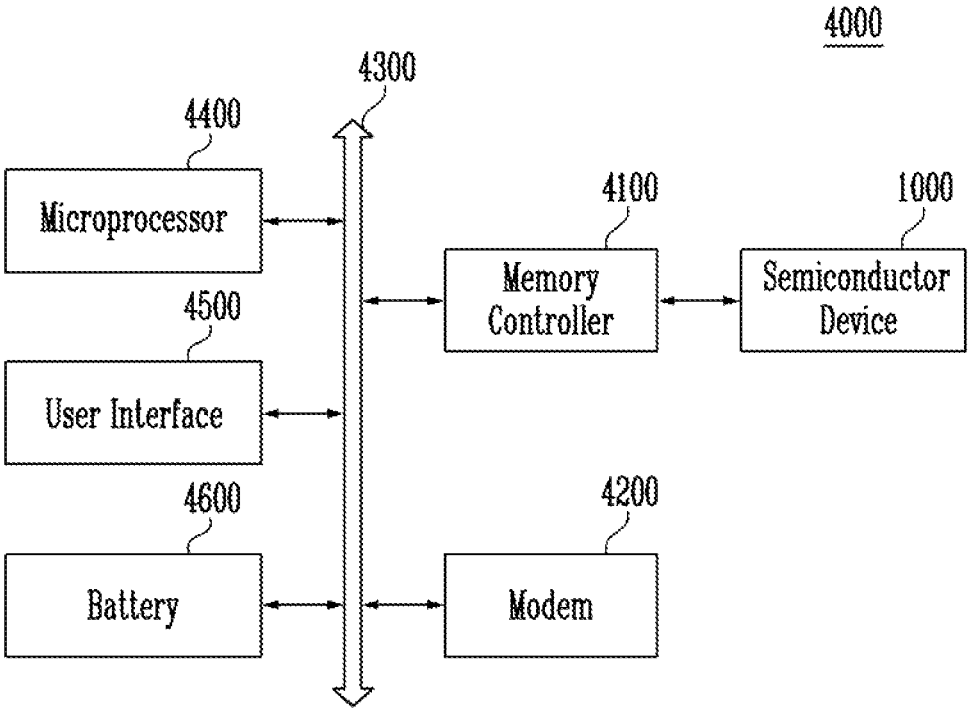
FIG. 6 is a schematic block diagram of a computing system including a semiconductor device according to an exemplary embodiment of the present invention.

FIG. 6 is a schematic block diagram of a computing system including a semiconductor device according to an exemplary embodiment of the present invention.

Referring to FIG. 6, a computing system 4000 according to the embodiment of the present invention may include a semiconductor device 1000, a memory controller 4100, a modem 4200, a microprocessor 4400, and a user interface (I/F) 4500, which are electrically connected to a bus 4300. When the computing system 4000 according to the embodiment of the present invention is a mobile device, a battery 4600 for supplying an operating voltage to the computing system 4000 may be further provided. Although not shown in FIG. 6, the computing system according to the embodiment of the present invention may further include an application chip set, a camera image processor (CIS), a mobile DRAM, etc.

Since the semiconductor device 1000 may substantially have the same construction as FIG. 1, a detailed description thereof will be omitted.

The memory controller 4100 and the semiconductor device may configure a SSD.

The semiconductor device 1000 and the memory controller 4100 according to the embodiment of the present invention may be mounted using various types of packages. For example, the semiconductor device 1000 and the memory controller 4100 according to the embodiment of the present invention may be packaged and mounted in various ways, such as a package on package (PoP), a ball grid array (BGA), a chip scale package (CSP), a plastic leaded chip carrier (PLCC), a plastic dual in line package (PDIP), a die in waffle pack, a die in wafer form, a chip on board (COB), a ceramic dual in line package (CERDIP), a plastic metric quad flat package (MQFP), a thin quad flat pack (TQFP), a small outline integrated circuit (SOIC), a shrink small outline package (SSOP), a thin small outline package (TSOP), a system in package (SIP), a multi chip package (MCP), a wafer-level fabricated package (WFP), a wafer-level processed stack package (WSP), or the like.

According to embodiments of the present invention, the voltage output, when changing from standby mode to active mode, may reach a normal level quickly by changing the construction and operating method of the active driver. Accordingly, the operating speed and reliability of a semiconductor device including the active driver may be improved.

The drawings and specification have disclosed exemplary embodiments of the inventive concept. Although specific terms are employed, they are used in a generic and descriptive sense only and are not intended to limit the inventive concept. As for the scope of the invention, it is to be set forth in the following claims. Therefore, it will be understood by those of ordinary skill in the art that various changes in form and detail may be made without departing from the spirit and scope of the present invention as defined by the following claims.

What is claimed is:

1. An active driver, comprising:

a mirror circuit suitable for generating a drive voltage and a sink voltage using an external voltage;

a first reset circuit suitable for outputting the drive voltage of a logic high level in a standby mode;

a second reset circuit suitable for transitioning the drive voltage to a logic low level in response to the sink voltage when being changed from the standby mode to an active mode; and an output circuit suitable for outputting the external voltage as an internal voltage in response to the drive voltage when being changed from the standby mode to the active mode.

2. The active driver of claim 1, wherein the mirror circuit outputs the drive voltage and the sink voltage in response to a drive enable signal, a standby reference voltage, and an active reference voltage.

3. The active driver of claim 2, wherein the mirror circuit comprises:

a first switch suitable for increasing a first active voltage using the external voltage in response to the drive enable signal in the standby mode;

a second switch suitable for increasing the sink voltage using the external voltage in response to the first active voltage in the active mode;

a third switch suitable or preventing a drop of the external voltage;

a fourth switch connected between a ground terminal and the third switch, and suitable for decreasing the first active voltage in response to the active reference voltage in the active mode;

a fifth switch suitable for increasing a second active voltage using the external voltage in response to the drive enable signal in the standby mode;

a sixth switch suitable or preventing the drop of the external voltage;

a seventh switch suitable for increasing the drive voltage using the external voltage in response to the second active voltage in the active mode; and an eighth switch connected between the ground terminal and the sixth switch, and suitable for decreasing the second active voltage in response to the standby reference voltage in the active mode.

4. The active driver of claim 3, wherein each of the drive enable signal, the standby reference voltage, and the active reference voltage has the logic low level in the standby mode, and has the logic high level in the active mode.

5. The active driver of claim 1, wherein the first reset circuit comprises a switch suitable for increasing the drive voltage using the external voltage in the standby mode, and preventing the drive voltage from increasing in the active mode, in response to a drive enable signal.

6. The active driver of claim 1, wherein the second reset circuit comprises:

a ninth switch suitable for preventing a drop of the sink voltage in the active mode;

a tenth switch suitable for decreasing the drive voltage in response to the sink voltage in the active mode; and an eleventh switch suitable for decreasing the sink voltage in the standby mode.

7. The active driver of claim 1, wherein the output circuit comprises:

a thirteenth switch suitable for preventing the internal voltage from changing due to the external voltage in the standby mode, and transferring the external voltage to an output node of the internal voltage in the active mode;

a current path circuit suitable for forming a current path between the output node and a ground terminal in the active mode in response to an inverted drive enable signal; and a discharge circuit suitable for discharging the current path circuit in response to the inverted drive enable signal in the standby mode.

8. The active driver of claim 7, wherein the current path circuit comprises:

a fourteenth switch suitable for being turned on or off in response to the inverted drive enable signal; and first and second diodes connected between the fourteenth switch and the ground terminal, and having a forward bias from the fourteenth switch and the ground terminal.

9. The active driver of claim 8, wherein the discharge circuit discharges a potential of a node between the first and second diodes.

10. A semiconductor device, comprising:

an internal circuit in which data is stored; and an internal voltage generator suitable for supplying an internal voltage to the internal circuit when being changed from a standby mode to an active mode, wherein the internal voltage generator comprises:

a mirror circuit suitable for generating a drive voltage and a sink voltage using an external voltage;

a first reset circuit suitable for outputting the drive voltage of a logic high level in the standby mode;

a second reset circuit suitable for transitioning the drive voltage to a logic low level state in response to the sink voltage when being changed from the standby mode to the active mode; and an output circuit suitable for outputting the external voltage as the internal voltage in response to the drive voltage when being changed from the standby mode to the active mode.

11. The semiconductor device of claim 10, wherein the mirror circuit outputs the drive voltage and the sink voltage in response to a drive enable signal, a standby reference voltage, and an active reference voltage.

12. The semiconductor device of claim 11, wherein the mirror circuit comprises:

a first switch suitable for increasing a first active voltage using the external voltage in response to the drive enable signal in the standby mode;

a second switch suitable for increasing the sink voltage using the external voltage in response to the first active voltage in the active mode;

a third switch suitable for preventing a drop of the external voltage;

a fourth switch connected between a ground terminal and the third switch, and suitable for decreasing the first active voltage in response to the active reference voltage in the active mode;

a fifth switch suitable for increasing a second active voltage using the external voltage in response to the drive enable signal in the standby mode;

a sixth switch suitable or preventing the drop of the external voltage;

a seventh switch suitable for increasing the drive voltage using the external voltage in response to the second active voltage in the active mode; and an eighth switch connected between the ground terminal and the sixth switch, and suitable for decreasing the second active voltage in response to the standby reference voltage in the active mode.

13. The semiconductor device of claim 12, wherein each of the drive enable signal, the standby reference voltage, and the active reference voltage has a logic low level in the standby mode, and has a logic high level in the active mode.

14. The semiconductor device of claim 13, wherein the first reset circuit comprises a switch suitable for increasing the drive voltage using the external voltage in the standby mode, and preventing the drive voltage from increasing in the active mode, in response to a drive enable signal.

15. The semiconductor device of claim 10, wherein the second reset circuit comprises:

a ninth switch suitable for preventing a drop of the sink voltage in the active mode;

a tenth switch suitable for decreasing the drive voltage in response to the sink voltage in the active mode; and an eleventh switch suitable for decreasing the sink voltage in the standby mode.

16. The semiconductor device of claim 10, wherein the output circuit comprises:

a thirteenth switch suitable for preventing the internal voltage from changing due to the external voltage in the standby mode, and transferring the external voltage to an output node of the internal voltage in the active mode;

a current path circuit suitable for forming a current path between the output node and a ground terminal in the active mode, in response to an inverted drive enable signal; and a discharge circuit suitable for discharging the current path circuit in response to the inverted drive enable signal in the standby mode.

17. The semiconductor device of claim 16, wherein the current path circuit comprises:

a fourteenth switch suitable for being turned on or off in response to the inverted drive enable signal; and first and second diodes connected between the fourteenth switch and the ground terminal, and having a forward bias from the fourteenth switch and the ground terminal.

18. The semiconductor device of claim 17, wherein the discharge circuit discharges a potential of a node between the first and second diodes.

* * * * *